US011788334B2

(12) United States Patent
Bonomi

(10) Patent No.: US 11,788,334 B2
(45) Date of Patent: Oct. 17, 2023

(54) MOVABLE PANELS SYSTEM WITH CARRIAGE DEVICE

(71) Applicant: METALGLAS BONOMI S.R.L., Lumezzane (IT)

(72) Inventor: Giordano Bonomi, Lumezzane (IT)

(73) Assignee: METALGLAS BONOMI S.R.L., Lumezzane (IT)

( * ) Notice: Subject to any disclaimer, the term of this patent is extended or adjusted under 35 U.S.C. 154(b) by 0 days.

(21) Appl. No.: 17/774,206

(22) PCT Filed: Oct. 15, 2020

(86) PCT No.: PCT/IB2020/059691

§ 371 (c)(1),
(2) Date: May 4, 2022

(87) PCT Pub. No.: WO2021/094855

PCT Pub. Date: May 20, 2021

(65) Prior Publication Data

US 2022/0372807 A1 Nov. 24, 2022

(30) Foreign Application Priority Data

Nov. 12, 2019 (IT) ..... 102019000020904

(51) Int. Cl.
*E05D 15/06* (2006.01)

(52) U.S. Cl.
CPC ..... *E05D 15/0669* (2013.01); *E05D 15/0686* (2013.01); *E05Y 2201/64* (2013.01);
(Continued)

(58) Field of Classification Search
CPC ..... E05D 15/0669; E05D 15/0686; E05Y 2201/64; E05Y 2201/684; E05Y 2201/688;
(Continued)

(56) References Cited

U.S. PATENT DOCUMENTS 3,298,136 A * 1/1967 Saunders ..... E05D 15/0669 16/105
3,670,357 A * 6/1972 Steigerwald ..... E05D 15/0669 16/105
(Continued)

FOREIGN PATENT DOCUMENTS

EP 2151538 A1 2/2010
EP 2248976 A1 11/2010
(Continued)

OTHER PUBLICATIONS

International Search Report, issued in PCT/IB2020/059691, dated Jan. 21, 2021, Rijswijk, NL.

*Primary Examiner* — Jerry E Redman
(74) *Attorney, Agent, or Firm* — ArentFox Schiff LLP; Michael Fainberg

(57) ABSTRACT

A movable panel system is provided which has a guide provided with at least one rail, at least one glass panel and a carriage device slidingly supporting the at least one glass panel on the at least one rail. The carriage device has a carriage body engaged to the at least one glass panel, and a wheel group having at least two wheels, configured to slidingly engage the at least one rail, and a support frame, the at least two wheels being hinged, rotationally free, to the support frame. The carriage body and the support frame are mutually engaged by a hinge that allows reciprocal rotation.

14 Claims, 6 Drawing Sheets

(52) U.S. Cl.
CPC ... *E05Y 2201/684* (2013.01); *E05Y 2201/688* (2013.01); *E05Y 2600/12* (2013.01); *E05Y 2600/45* (2013.01); *E05Y 2600/632* (2013.01); *E05Y 2900/142* (2013.01)

(58) Field of Classification Search
CPC ..... E05Y 2201/218; E05Y 2201/236; E05Y 2201/244; E05Y 2201/614; E05Y 2600/12; E05Y 2600/45; E05Y 2600/632; E05Y 2600/40; E05Y 2900/142; E05Y 2900/132
USPC ..... 49/425, 417, 418, 420, 421
See application file for complete search history.

(56) References Cited

U.S. PATENT DOCUMENTS 3,996,643 A * 12/1976 Steigerwald ..... E05D 15/0669 16/99
4,006,513 A * 2/1977 Offterdinger ..... E05D 15/0669 49/420
4,014,073 A * 3/1977 Uehara ..... E05D 15/0669 252/604
4,262,451 A * 4/1981 Dallaire ..... E05D 15/0669 16/99
4,404,771 A * 9/1983 Murase ..... E05D 15/0669 49/420
4,633,615 A * 1/1987 Moose ..... E05D 15/0669 16/105
5,018,306 A * 5/1991 Prevot ..... E05D 15/0669 49/425
5,791,089 A * 8/1998 Prevot ..... E05D 15/0669 49/425
5,971,408 A * 10/1999 Mandel ..... F16M 11/22 248/188.4
6,681,445 B2 * 1/2004 Huang ..... E05D 15/0669 16/105
7,293,389 B2 * 11/2007 Jacobs ..... E05D 15/0691 16/93 R
7,770,329 B2 * 8/2010 Hutnik ..... E05D 15/0669 49/411
8,240,089 B2 * 8/2012 Lambertini ..... E05D 15/565 49/226
9,080,359 B2 * 7/2015 Horwood ..... E05D 15/0669
9,085,924 B2 * 7/2015 Tidwell ..... E05D 15/0669
11,274,480 B2 * 3/2022 Minter ..... E05D 15/0634
2005/0011041 A1 * 1/2005 Ness ..... E05D 15/0669 16/105
2005/0235571 A1 * 10/2005 Ewing ..... E05D 15/0634 49/410
2009/0019665 A1 * 1/2009 Kelley ..... E05D 15/066 16/105

FOREIGN PATENT DOCUMENTS

EP 2476840 A1 7/2012
EP 2829678 A1 1/2015
JP 06137019 A * 5/1994
KR 102503989 B1 * 2/2023

* cited by examiner

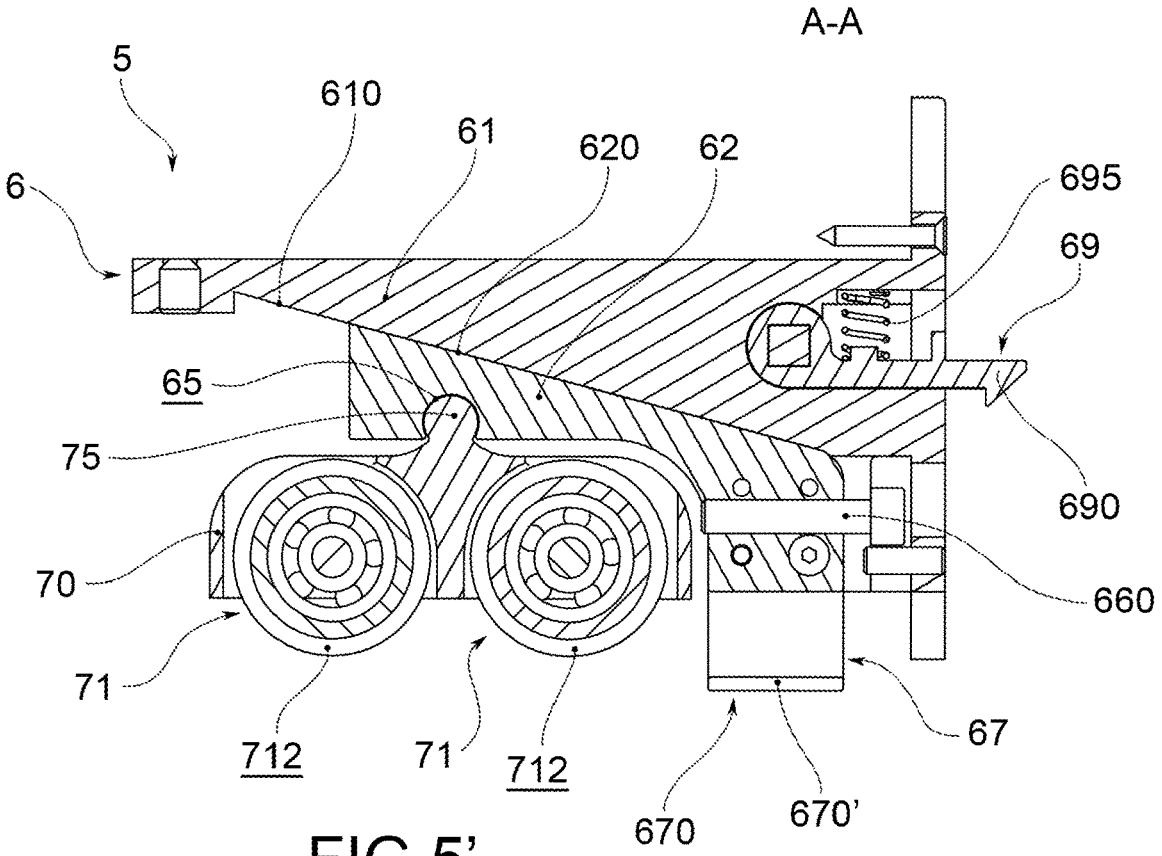
FIG.5'
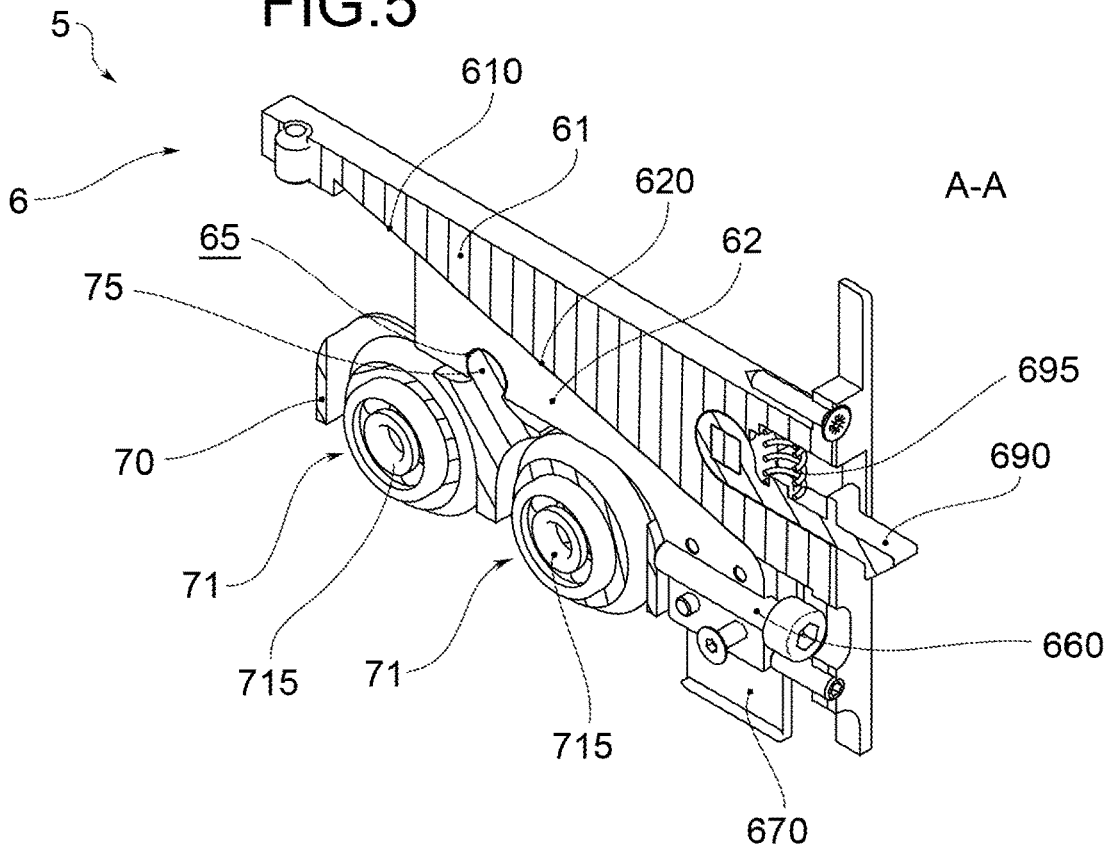
FIG.5"

MOVABLE PANELS SYSTEM WITH CARRIAGE DEVICE

CROSS-REFERENCE TO RELATED APPLICATIONS

This application is a National Phase Application of PCT International Application No. PCT/IB2020/059691, having an International Filing Date of Oct. 15, 2020 which claims priority to Italian Application No. 102019000020904 filed Nov. 12, 2019, each of which is hereby incorporated by reference in its entirety.

FIELD OF THE INVENTION

The present invention relates to a system of packable movable panels, in particular glass panels.

BACKGROUND OF THE INVENTION

Packable movable panel systems are known from the prior art, which allow to close a room, e.g. a veranda, when desired, e.g. in bad weather, so that it can be used as an additional sheltered space. On the other hand, in good weather conditions, such a space can be used as an outdoor environment by means of such packable movable panel systems, by arranging said panels in a packaged configuration.

In the known embodiments, the panels, preferably made of glass, are large in size, so as to allow effective lighting of the space even with the panels in the closed position.

Moving the large glass panels is not easy. Indeed, there are special guides and appropriate sliding means suitable to operate with them to move the panels.

It is also apparent that large glass panels require specific guide solutions, and especially carriage devices suitable to support the glass panel slidingly in an effective and reliable manner, especially over time.

In particular, the larger the size of the glass panels the more the carriage device becomes a critical component of the movable panel system.

SUMMARY OF THE INVENTION

It is the object of the present invention to create a system with packable movable panels that ensures an efficient and reliable movement of glass panels over time.

Such an object is achieved by a packable movable panel system as described and claimed herein.

BRIEF DESCRIPTION OF THE DRAWINGS

The features and advantages of the movable panel system according to the present invention will become apparent from the following description, given by way of non-limiting example, according to the accompanying drawings, in which:

FIGS. 5' and 5" are two section views, front and perspective, respectively, taken along the plane A-A in FIG. 4";

Figure 1:
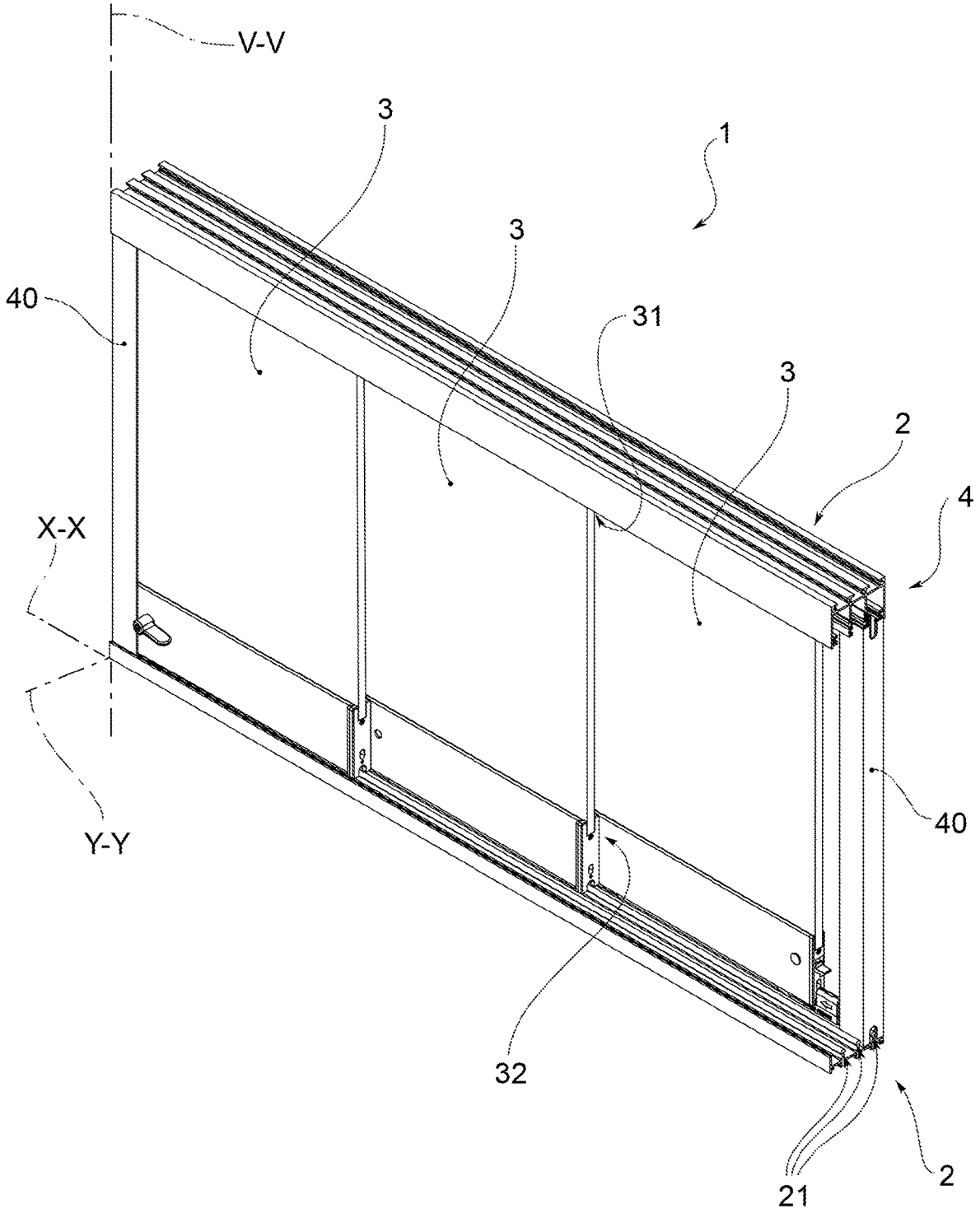
FIG. 1 shows a perspective view of the packable movable panel system, according to a preferred embodiment.
Figure 2:
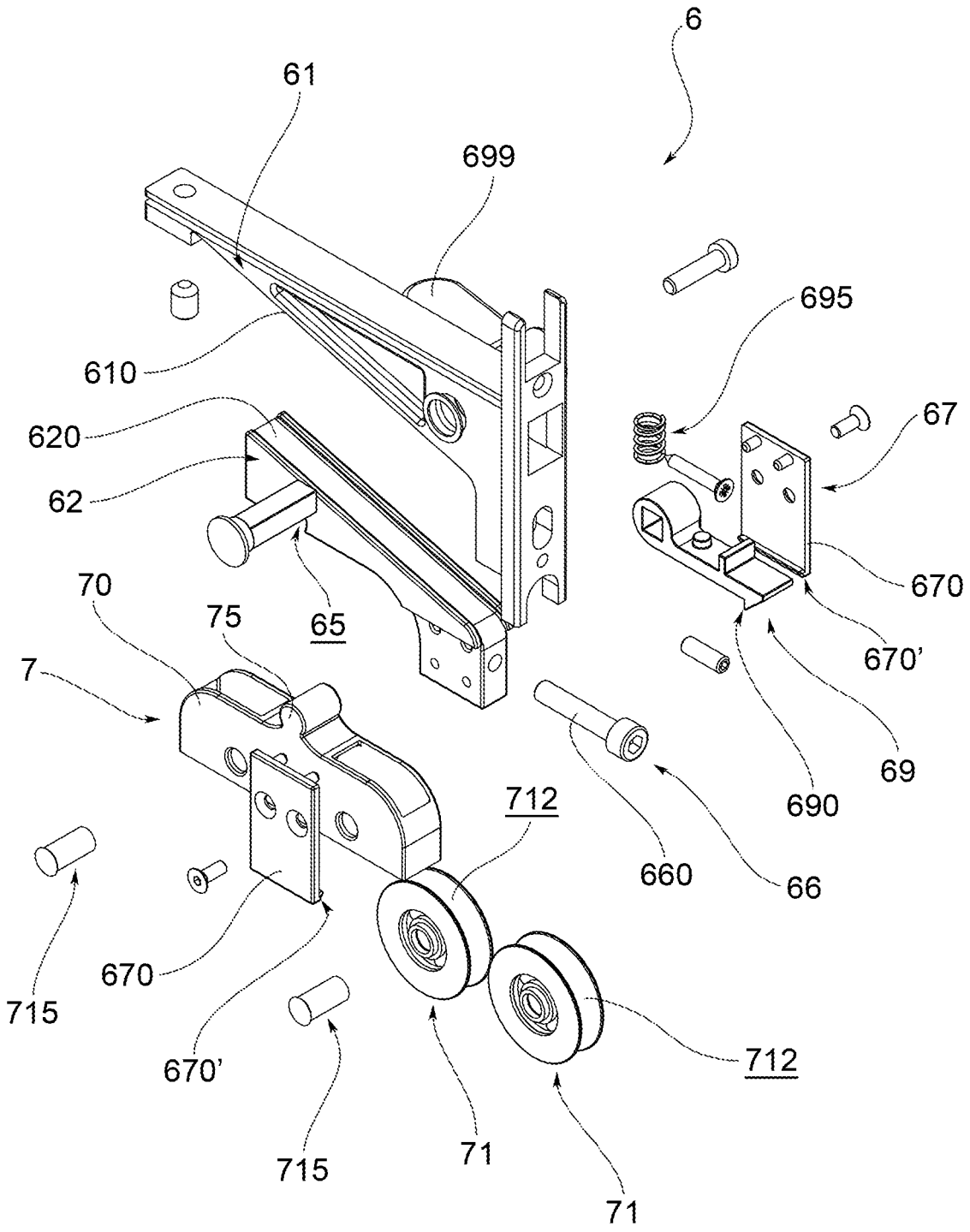
FIG. 2 is a perspective view with parts separated of a carriage device provided in the movable panel system, according to a preferred embodiment.
Figure 3:
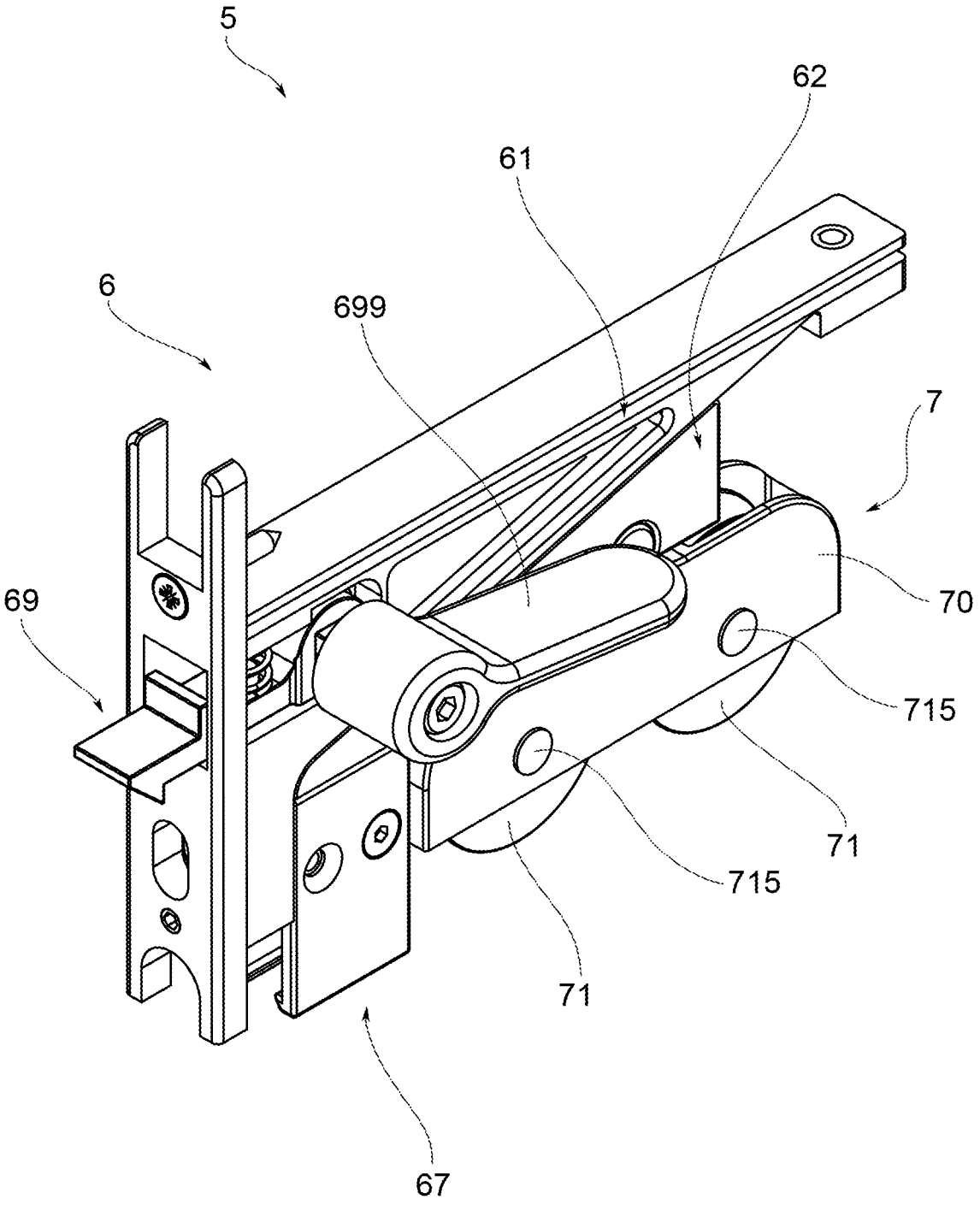
FIG. 3 shows a perspective view of a carriage device provided in the movable panel system, according to a preferred embodiment.
Figure 4:
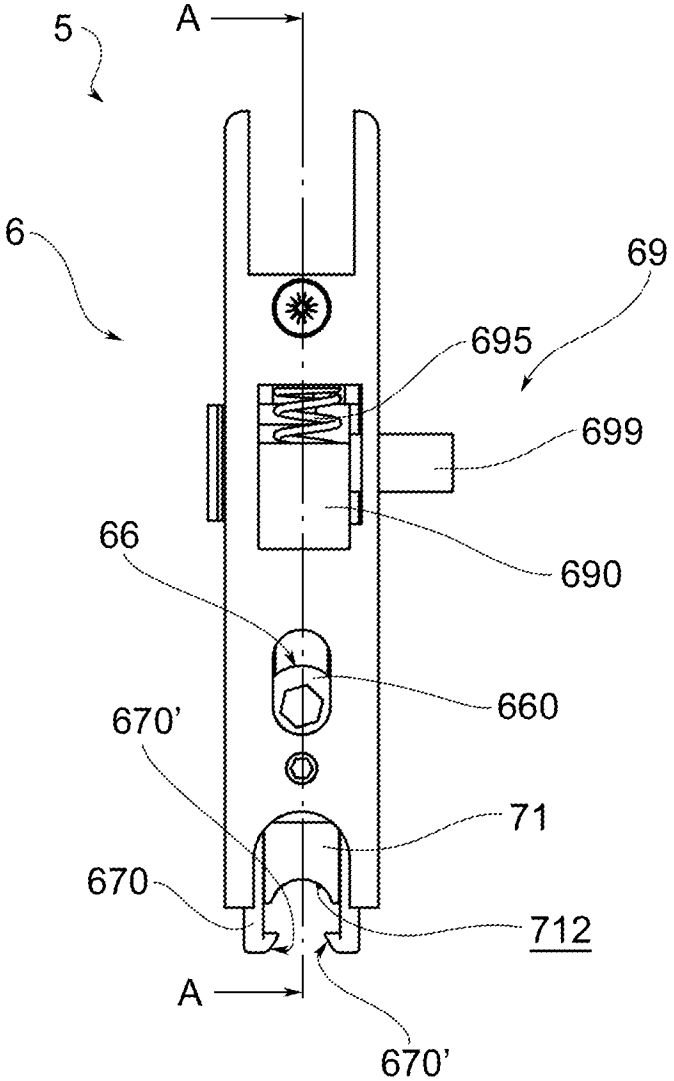
FIGS. 4' and 4" show two front views of the carriage device, in which the first one shows the engagement with a rail.
Figure 4:
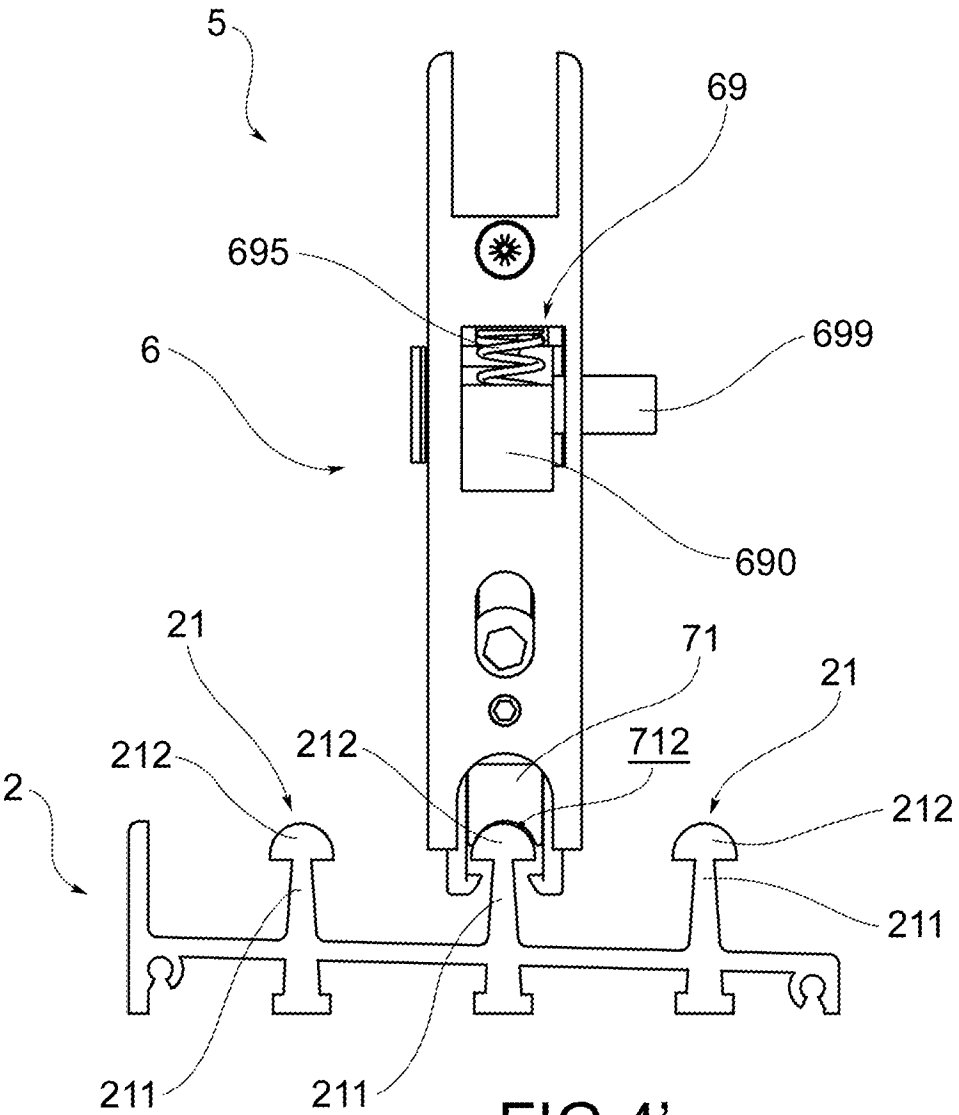

FIGS. **6*a* and 6*b*** show two side views of a carriage device in two operating configurations, and thus two different heights of the wheel group.

DETAILED DESCRIPTION

Reference numeral 1 in the accompanying figures indicates a movable panel system according to a preferred embodiment of the present invention.

Preferably, in the following description and in the accompanying figures, reference will be made to a longitudinal dimension, along a longitudinal axis X-X, along which the movable panels move. Furthermore, reference is made to a vertical dimension, along a vertical axis V-V, along which the panels extend. Additionally, reference is made to a transverse dimension, along a transverse axis Y-Y, substantially orthogonal to the preceding dimensions.

In particular, the movable panel system 1 of the present invention is not limited either to or by the number of glass panels 3 comprised therein.

In the preferred embodiment, shown in the accompanying figures, the movable panel system 1 comprises three panels.

According to a preferred embodiment, the movable panel system 1 comprises a guide 2 comprising at least one rail 21 which extends along a longitudinal axis X-X. Preferably, the longitudinal axis X-X is rectilinear.

According to a preferred embodiment, said guide 2 is preferably the lower guide.

According to a preferred embodiment, the movable panel system 1 comprises two guides 2, a lower guide and an upper guide.

According to a preferred embodiment, at each corresponding glass panel 3, the guide 2 comprises a respective rail 21 onto which said glass panel 3 is free to slide.

According to a preferred embodiment, each guide 2 consists of a single element, preferably a section bar, preferably extruded, preferably made of metal, e.g. aluminum.

According to a construction variant, each guide 2 consists of a plurality of elements, preferably aligned along the longitudinal axis X-X.

According to a preferred embodiment, the movable panel system 1 comprises a containment frame 4 in which the glass panels 3 are contained.

Preferably, the containment frame 4 comprises two end jambs 40 at the axial ends of guide 2 (or of the guides 2).

Preferably, the guide 2 is (the guides 2 are) comprised in the containment frame 4, positioned at a lower end (and at an upper end) of each end jamb 40.

As mentioned, at least one glass panel 3 which extends planarly on an imaginary panel plane is comprised in the movable panel system 1 of the present invention.

Said glass panel 3 comprises a first edge 31, preferably upper, and a second edge 32, preferably lower.

According to the present invention, the movable panel system 1 comprises at least one carriage device 5 which slidingly supports the glass panel 3 onto the guide 2.

According to the present invention, said carriage device 5 is engaged (preferably mounted, preferably fixed) on a respective edge of the panel.

Preferably, said carriage device 5 is engaged (preferably mounted, preferably fixed) with said second edge 32.

Preferably, said carriage device 5 is also engaged (preferably mounted on, preferably fixed to) with said first edge 31.

According to a preferred embodiment, for each glass panel 3 there are two carriage devices 5 positioned respectively at the two longitudinal ends of the respective second edge 32.

Preferably, in a preferred embodiment, for each glass panel 3 there are two carriage devices 5 positioned respectively at the two longitudinal ends also of the first edge 31.

According to the present invention, the carriage device 5 comprises a carriage body 6 engaged with the glass panel 3. Indeed, the carriage body 6 is the element by means of which the carriage device 5 is solidly connected to the glass panel 3.

The peculiarities of the carriage body 6 are described below.

According to the present invention, the carriage device 5 further comprises a wheel group 7, which comprises two wheels 71 suitable to slidingly engage the rail 21.

Said wheel group 7 comprises a support frame 70 to which the wheels 71 are hinged to be rotationally free.

Preferably, the wheels 71 comprise wheel pivots 715 by means of which they are rotationally fixed to the carriage body 6.

In particular, according to the present invention, the carriage body 6 and the support frame 70 are mutually engaged by a hinge, which allows reciprocal rotation.

According to a preferred embodiment, the carriage body 6 comprises a housing seat 65 and the support structure 70 comprises a hinging pin 75 which is housable in said housing seat 65 rotationally free. According to a preferred embodiment, the hinging pin 75 extends transversally; similarly, according to a preferred embodiment, the housing seat 65 has a complementary shape.

According to a preferred embodiment, the two wheels 71 are axially aligned having respective rotation axes lying on the same imaginary plane.

Preferably, the wheels 71 are mounted so as to be aligned longitudinally.

Preferably, the wheel pivots 715 are mounted to be parallel to the transverse axis Y-Y.

According to a preferred embodiment, the hinging pin 75 is positioned longitudinally in a region between two wheels 71, preferably at the center line of the distance present between the two hinging points of two wheels on the support frame 70.

According to a preferred embodiment, "two-wheeled", the hinging pin 75 is positioned on the middle line of the two wheels 71.

According to a preferred embodiment, with an even number of wheels, the hinging pin 75 is positioned in the middle of the wheel group, in a middle region between the two central wheels 71.

According to a preferred embodiment, with an odd number of wheels, the hinging pin 75 is positioned aligned with the central wheel.

In other words, the action due to the weight of the glass panel 3 is relieved onto the respective rail by means of the wheels 71 provided in the carriage device 5.

According to a preferred embodiment, the carriage body 6 comprises an upper structure 61 solidly connected to the glass panel 3 and a lower structure 62 with which the wheel group 7 is engaged.

According to a preferred embodiment, the upper structure 61 and the lower structure 62 are mutually positionable in a plurality of relative positions as a function of needs.

In particular, indeed, each relative position of the upper structure 61 with respect to the structure 62 corresponds to a respective distance between wheel group 7 and second edge 32 of the glass panel 3.

Preferably, therefore, the adjustment of the position of the two structures allows the height regulation of the glass panel 3.

According to a preferred embodiment, the upper structure 61 and the lower structure 62 respectively comprise an upper inclined plane 610 and a lower inclined plane 620 suitable to allow sliding operations on each other.

As shown in the accompanying figures, said inclined planes are angled with respect to the longitudinal direction.

According to a preferred embodiment, the carriage body 6 comprises an adjustment member 66 engaged in both the lower structure 62 and the upper structure 61.

Preferably, the adjustment member 66 is operable to adjust the mutual position of the lower structure 62 with respect to the upper structure 61. In other words, the adjustment member 66 imposes a preferred position of the lower structure 62 with respect to the upper structure 61 (the latter fixed to the glass panel 3).

According to a preferred embodiment, the adjustment member 66 is a screw element 660 having a longitudinal extension such that its rotation implies a longitudinal and vertical adjustment of the lower structure 62 with respect to the upper structure 61.

Figure 6A:
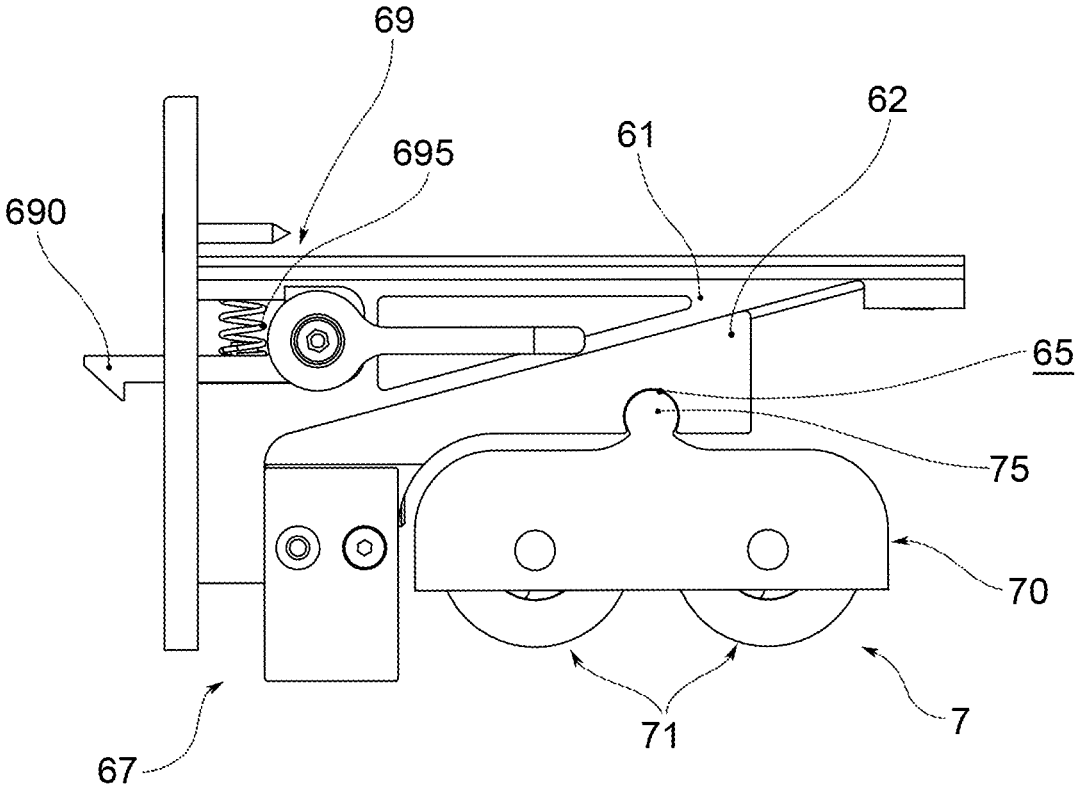
Figure 6B:
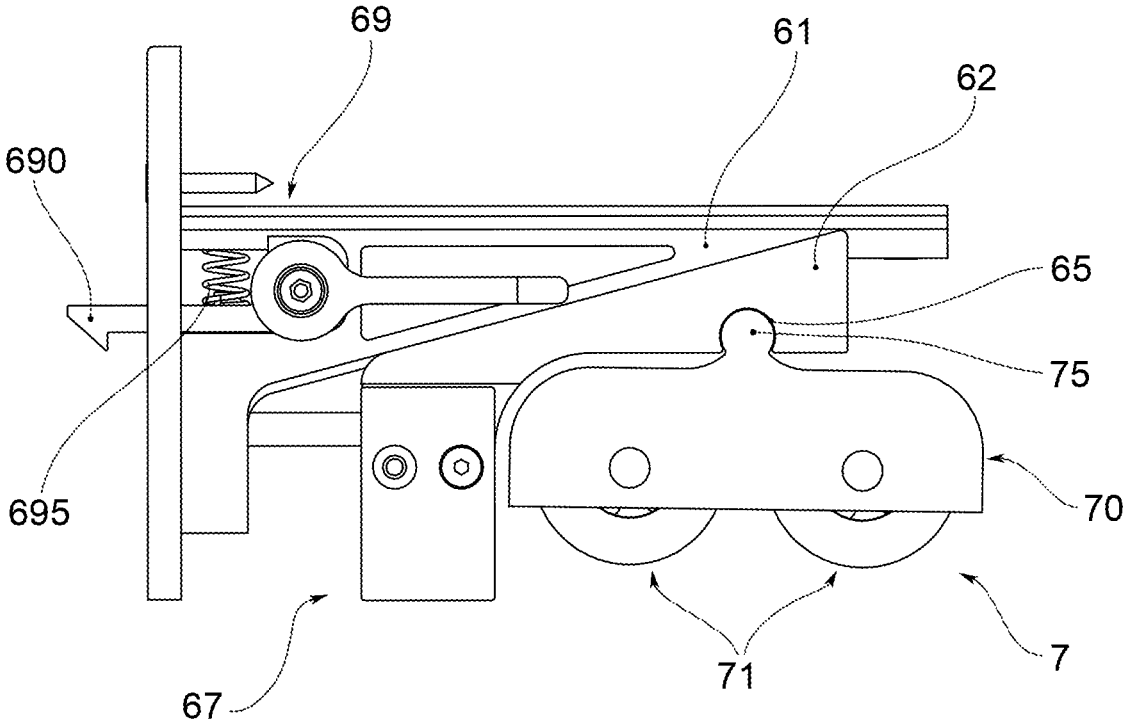

An example of adjustment of the two structures is shown by way of example in FIGS. 6*a* and 6*b*.

According to a preferred embodiment, each rail 21 comprises a stem 211 and a head 212, having a substantially T-shaped cross-section.

According to a preferred embodiment, the wheels 71 slide on said head 212 comprising a central slot 712 in which said head 212 is seated.

According to a preferred embodiment, the carriage body 6 further comprises an anti-lifting member 67 comprising two teeth 670 facing each other.

Preferably, the anti-lifting member 67 is suitable to avoid a relative lifting of the carriage device 5, and thus of the glass panel 3, with respect to the guide 2.

According to a preferred embodiment, the head 212 is seated in the space between the two teeth 670, which comprise projections 670' that protrude transversely towards each other to avoid an axial movement. In other words, the anti-lifting member 67 contains the head 212 of the rail 21 therein.

Preferably, the anti-lifting member 67 is mounted on the lower structure 62. In other words, the anti-lifting member 67 is also subject to relative height adjustment with respect to the guide.

Preferably, the teeth 670 are made of soft material, e.g. plastic material, to allow inserting the carriage device 5 onto the respective rail 21 also in a vertical direction.

In addition, according to a preferred embodiment, in which the carriage body 6 further comprises a fixing member 69 suitable to engage a respective end jamb 40 to fix the respective panel 3 to the jamb.

Preferably, the fixing member 69 is fixed and partially housed in the upper structure 61.

Preferably, the fixing member 69 comprises a fixing tooth 690 and elastic fixing elements 695 suitable to push on the fixing tooth 690 to keep it in a fixing position.

Preferably, to release the glass panel 3 from the end jamb 40, it is necessary to perform an operation on the fixing member 69, which overcomes the pushing action produced by the elastic fixing element 695.

Preferably, the fixing member 69 comprises a command lever 699 suitable to allow said operation.

Innovatively, the movable panel system has a particularly efficient and reliable translational movement of the respective panels.

Advantageously, the carriage device is suitable to move glass panels of large dimensions, and, therefore, of heavy weight.

Advantageously, the carriage device allows an effective sliding on the respective guide.

Advantageously, the carriage device has a wheel assembly which adapts to the shape and possible inclination of a respective rail.

Advantageously, the carriage body is adjustable simply and intuitively to adjust the height of the glass panels.

Advantageously, the anti-lifting member ensures the vertical blocking of the carriage device to the respective rail. Advantageously, the anti-lifting member allows an engagement thereof with the rail in a vertical direction.

Advantageously, the fixing member allows a simple coupling action as well as a simple releasing action.

In order to meet contingent needs, it is apparent that those skilled in the art may make changes to the panel system described above, all of which are contained within the scope of protection as defined in the following claims.

In order to meet specific requirements, those skilled in the art may make variations to the embodiments of the movable panel system of the present invention or replace elements with others which are functionally equivalent. Furthermore, each variant described as belonging to a possible embodiment may be implemented irrespective of the other variants.

The invention claimed is:

1. A movable panel system, comprising:

a lower guide comprising at least one rail that extends along a longitudinal axis;

at least one glass panel that extends planarly on an imaginary panel plane, wherein the at least one glass panel comprises a first upper edge, and a second lower edge;

at least one carriage device that slidingly supports the at least one glass panel on the lower guide, the at least one carriage device being engaged to said second lower edge, wherein the at least one carriage device comprises:

a carriage body engaged to the at least one glass panel; and a wheel group comprising at least two wheels configured to slidingly engage the at least one rail, and a support frame, the at least two wheels being hinged, rotationally free, to the support frame, the carriage body and the support frame being mutually engaged by a hinge that allows reciprocal rotation;

wherein the carriage body comprises a housing seat and the support frame comprises a hinging pin housable in said housing seat rotationally free;

wherein the carriage body comprises an upper structure integrally connected to the at least one glass panel and a lower structure to which the wheel group is engaged; and wherein the upper structure and the lower structure comprise an upper inclined plane and a lower inclined plane, respectively, the upper and lower inclined planes being configured to slide on each other, and the upper and lower structures being mutually positionable in a plurality of positions, each position corresponding to a respective distance between the wheel group and the second lower edge of the at least one glass panel.

2. The movable panel system of claim 1, wherein said wheel group comprises two wheels.

3. The movable panel system of claim 2, wherein the two wheels are axially aligned, the two wheels having respective axes of rotation lying on a same imaginary plane.

4. The movable panel system of claim 1, wherein the hinging pin is positioned longitudinally in a region comprised between two wheels.

5. The movable panel system of claim 1, wherein the hinging pin is positioned at a centerline of a distance between two hinging points of two wheels on the support frame.

6. The movable panel system of claim 1, wherein the carriage body comprises an adjustment member engaged both with the lower structure and with the upper structure, and wherein the adjustment member is configured to adjust reciprocal position of the lower structure with respect to the upper structure.

7. The movable panel system of claim 6, wherein the adjustment member is a screw element having a longitudinal extension so that a rotation of the adjustment member involves longitudinal and vertical adjustment of the lower structure with respect to the upper structure.

8. The movable panel system of claim 1, wherein the at least one rail comprises a stem and a head having a T-shaped cross-section, and wherein said at least two wheels slide on said head, said at least two wheels comprising a central slot, in which said head is seated.

9. The movable panel system of claim 8, wherein the carriage body further comprises an anti-lifting member comprising two teeth facing each other, and wherein the head is seated in a space between the two teeth, the two teeth comprising projections transversely protruding towards each other to prevent axial movement.

10. The movable panel system of claim 1, wherein two carriage devices are positioned on the at least one glass panel, respectively in proximity of two longitudinal ends of the second lower edge.

11. The movable panel system of claim 1, comprising two guides, the lower guide and an upper guide, each guide comprising at least one rail.

12. The movable panel system of claim 1, comprising a plurality of glass panels, wherein each glass panel slides on a respective rail.

13. The movable panel system of claim 1, further comprising a containment frame that comprises two end jambs at axial ends of the lower guide, wherein the carriage body further comprises a fixing member configured to engage a respective end jamb to fix a respective glass panel to the end jamb.

14. The movable panel system of claim 13, wherein the fixing member comprises a fixing tooth and an elastic fixing element configured to perform a thrust action on the fixing tooth to keep the fixing tooth in a fixing position, so that to release the fixing member from the end jamb, an operation that overcomes the thrust action performed by the elastic fixing element is performed.

* * * * *